US007050888B2

(12) United States Patent
Schneider et al.

(10) Patent No.: US 7,050,888 B2
(45) Date of Patent: May 23, 2006

(54) CONTROL SYSTEM AND METHOD OF CONTROLLING AMMONIUM ABSORPTION REFRIGERATORS

(75) Inventors: Wayne Schneider, Botkins, OH (US); Mark Hipple, Sidney, OH (US)

(73) Assignee: Norcold, Inc., Sidney, OH (US)

( * ) Notice: Subject to any disclaimer, the term of this patent is extended or adjusted under 35 U.S.C. 154(b) by 0 days.

(21) Appl. No.: 10/723,288

(22) Filed: Nov. 26, 2003

(65) Prior Publication Data

US 2005/0113982 A1 May 26, 2005

(51) Int. Cl.
*G08B 19/00* (2006.01)
*F25B 17/00* (2006.01)

(52) U.S. Cl. ..... 700/300; 340/588; 62/148

(58) Field of Classification Search ..... 62/125–127, 62/129, 141–148, 476–481; 700/299, 300; 340/506, 507, 584, 585, 588; 337/301–303
See application file for complete search history.

(56) References Cited

U.S. PATENT DOCUMENTS 4,375,750 A * 3/1983 Blomberg ..... 62/101
4,487,030 A * 12/1984 Carter et al. ..... 62/141
5,138,846 A * 8/1992 Ogawa et al. ..... 62/148
5,156,013 A * 10/1992 Arima et al. ..... 62/148
5,217,064 A * 6/1993 Kellow et al. ..... 165/48.1
5,682,755 A * 11/1997 Uchida et al. ..... 62/148
5,697,225 A * 12/1997 Wada ..... 62/148
6,408,643 B1 * 6/2002 Takabatake et al. ..... 62/476
6,662,585 B1 * 12/2003 Muller et al. ..... 62/236
6,666,037 B1 * 12/2003 Hoshino et al. ..... 62/148
6,842,718 B1 * 1/2005 Byrd et al. ..... 702/182

* cited by examiner

*Primary Examiner*—Maria N. Von Buhr
(74) *Attorney, Agent, or Firm*—Harness, Dickey & Pierce, P.L.C.

(57) ABSTRACT

The present invention provides control systems and methods for a cooling unit. The system includes a temperature sensor that senses the temperature of a cooling fin and a circuit. The circuit may communicate with a signal from the cooling unit that indicates when cooling is required. The circuit also communicates with the sensor and turns off the heat source of the cooling unit if the temperature does not decrease within a pre-selected time after cooling becomes required. Additionally, the circuit may turn off the heat source only if the temperature is above a pre-selected temperature. Moreover, a pre-selected time after turning off the heat source, the circuit may turn the heat source on.

24 Claims, 2 Drawing Sheets

CONTROL SYSTEM AND METHOD OF CONTROLLING AMMONIUM ABSORPTION REFRIGERATORS

FIELD OF THE INVENTION

The present invention relates to cooling systems and more particularly to control systems for ammonia absorption refrigerators.

BACKGROUND OF THE INVENTION

Vehicles, including but not limited to recreational vehicles ("RVs", in the United States and "Caravans" in Europe), tractor trailers, airplanes, boats, trains and the like, often incorporate refrigerators for the comfort and convenience of the occupants. For example, recreational vehicle campers often find it convenient, or even necessary, to refrigerate food, drinks, and medicine during their journal and while at their campsites. While many prepared camp sites in parks and commercial campgrounds provide for electrical outlets, many do not. Moreover, many highly desirable camping locations exist outside of these prepared sites. Thus, a popular solution has been to equip the recreational vehicle with an absorption refrigerator.

Absorption refrigerators employ heat to vaporize the coolant—water mixture (typically ammonia-water) thereby driving the refrigeration loop in a manner well known to those skilled in the art. Popular heat sources include electrical heaters and fuel burners. Further, the fuel burners typically employ propane which is readily available at camping supply stores, barbeque supply stores, and numerous gas stations. Though, any liquid or gaseous fuel would work well and be controllable through simple, automated control systems.

In practice, the present inventor found that various problems might interfere with cooling the interior volume of the refrigerator while still leaving the heat source driving the refrigeration system. Since it is desirable to conserve energy, the present inventor recognized a need to turn off the heat source when refrigeration is no longer practicable.

SUMMARY OF THE INVENTION

The present invention is directed to an absorption refrigerator suitable for use by campers. More particularly, the present invention is directed to an economical and reliable refrigeration system monitor. Additionally, the present invention includes methods of monitoring the cooling provided by a cooling unit and apparatus to monitor cooling units.

In a preferred embodiment, the present invention includes a control system, for a cooling unit, including a temperature sensor that senses the temperature of a cooling fin and a circuit. The circuit may communicate with a signal from the cooling unit that indicates when cooling is required. The circuit also communicates with the sensor and turns off the heat source of the cooling unit if the temperature does not decrease within a pre-selected time after cooling becomes required. Additionally, the circuit may turn off the heat source only if the temperature is above a pre-selected temperature. Moreover, a pre-selected time after turning off the heat source, the circuit may turn the heat source on.

Furthermore, the circuit may be in communication with a reset signal and have memory to store an indication of whether the circuit has turned off the heat source. If the circuit receives the reset signal and the temperature begins decreasing, then the circuit clears the indication. If, though, the indication indicates that the circuit has turned off the heat source and the temperature does not decrease (when cooling is required) the circuit may lock out the heat source. To clear the lock out, the circuit may require that it receive a hardware reset.

In another preferred embodiment, the present invention provides a cooling unit comprising an interior volume; a cooling surface in the interior volume; a cooling system to cool the cooling surface; a heat source to provide the energy to drive the cooling system; a temperature sensor adapted to sense the temperature of the cooling surface; and a circuit. The circuit may communicate with a signal from the cooling unit that indicates when cooling of the cooling unit is required. The circuit also communicates with the sensor and turns off the heat source of the cooling unit if the temperature does not decrease within a pre-selected time after cooling becomes required. Additionally, the circuit may turn off the heat source only if the temperature is above a pre-selected temperature. Then, a pre-selected time after turning off the heat source, the circuit may turn the heat source back on.

Moreover, the circuit may be in communication with a reset signal and have a memory to store an indication of whether the circuit has turned off the heat source. If the circuit receives the reset signal and the temperature begins decreasing, then the circuit clears the indication. If, however, the indication indicates that the circuit has turned off the heat source and the temperature does not decrease (when cooling is required) then the circuit may lock out the heat source. To clear the lock out, the circuit of the present embodiment may receive a hardware reset.

In yet another preferred embodiment, the interior volume may include two sections. Moreover, the cooling system may include two evaporators in series, with each evaporator cooling one of the interior sections. Additionally, the cooling fin (with the temperature sensor) may be cooled by the evaporator downstream of the other evaporator. The cooling unit may also be a refrigerator.

In another form, the present invention includes a method of controlling a cooling unit. The method includes sensing a temperature of a cooling fin of the cooling unit and determining when cooling of the cooling unit is appropriate. If the temperature does not decrease within a pre-selected time from when cooling becomes appropriate, then a heat source of the cooling unit is turned off. Moreover, the method may include turning off the heat source only if the temperature is above a pre-selected temperature. The method may also include turning on the heat source a pre-selected time after turning off the heat source.

Furthermore, an indication of whether the circuit has turned off the heat source may be stored with the method including monitoring a reset signal and clearing the indication if the reset signal is received. The method may also include locking out the heat source if the indication indicates the circuit has turned off the heat source and the temperature does not decrease when cooling is required. To clear the lock out, the method may additionally include monitoring a hardware reset and, if the hardware reset is received, then clearing the lock out.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

The methods and systems described herein can be applied to a wide variety of cooling units. For the purpose of illustration, though, a typical absorption refrigeration system is used that has a cold storage compartment. Those skilled in the art will understand that the illustrative refrigeration system does not limit the invention in any way, but is used only to explain the invention.

Figure 1:
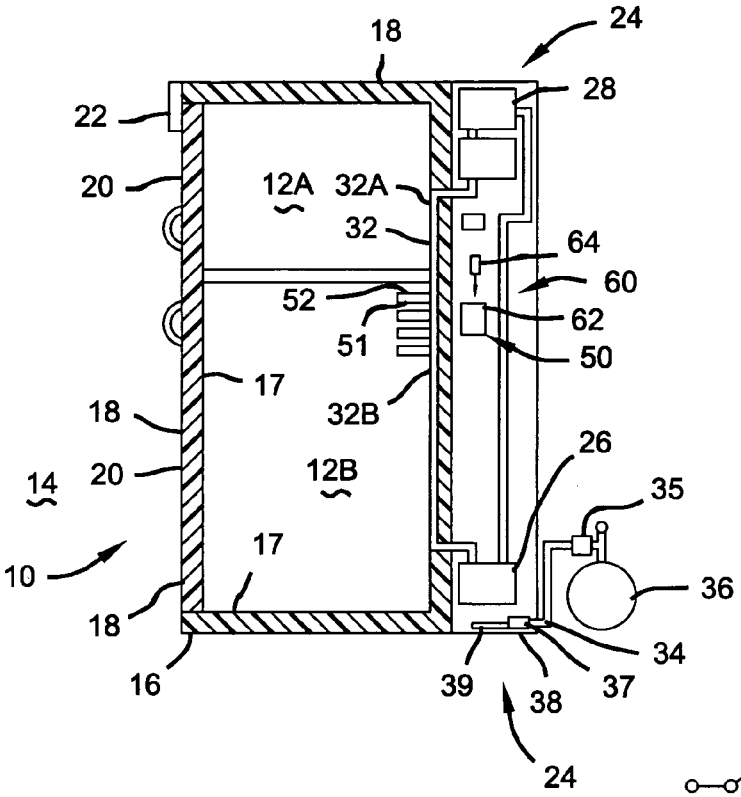
FIG. 1 is a cross-sectional side view of an absorption refrigerator including a control system in accordance with a preferred embodiment of the present invention.

With general reference to the drawings and with particular reference to FIG. 1, an absorption refrigerator 10 in accordance with a preferred embodiment of the present invention may be seen. The refrigerator 10 conventionally includes an interior volume 12 in which the user desires to store perishables and other items needing cooling. The interior volume 12 may be divided into two, or more, sections 12A and 12B with one section preferentially being kept cooler than the other interior section. An outer shell 16 provides protection for the various components of the refrigerator 10. The shell 16 also prevents warm air intrusion into the interior 12 and prevents cold air seepage from the interior 12. An insulating layer 18 (typically fiberglass) limits heat conduction into the interior 12 from the exterior 14. An inner shell 17 provides similar functions as that of the outer shell 16.

Figure 3:
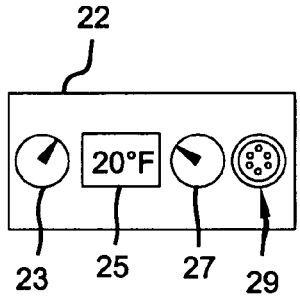
FIG. 3 is a front view of the control panel of FIG. 1.

A door 20 allows the user access to the interior 12. The door 20 also includes a portion of the insulation 18. Somewhere on the refrigerator 10 viewable by the user, a control panel 22 is provided so that the user can turn the refrigerator on and oft, adjust the temperature of one or more interior sections, and monitor the performance of the refrigerator 10. Controls for these functions are provided such as the on/oft switch 23, a temperature indicator 25, and a temperature set point selector 27 as shown in FIG. 3. More particularly, the control panel 22 includes a refrigeration monitor 29 to allow the user to determine whether the refrigeration system 24 is operating properly, as will be discussed more below.

Continuing with reference to FIG. 1, the refrigerator 10 also includes an absorption refrigeration system 24. Insofar as the present invention is concerned, the absorption refrigeration system 24 is conventional in construction and operation. Briefly, the absorption system 24 includes a generator 26, a condenser 28, a receiver 30, and an evaporator 32 arranged in a loop. In the generator 26, the coolant mixture (typically ammonia and water—anhydrous ammonia) absorbs heat thereby preferentially releasing ammonia vapor. From the generator 26, the ammonia vapor flows to the condenser 28.

In the condenser 28, the ammonia vapor cools and condenses. Outside air driven by a fan may be employed to provide the heat transfer necessary to condense the vapor in the condenser 28. By gravity, the cool liquid ammonia flows from the condenser 28 and into the receiver 30.

From the receiver 30, the liquid ammonia bleeds through an orifice (not shown) into the evaporator 32. In the evaporator 32, the liquid ammonia absorbs heat from the interior 12 thereby cooling the interior 12. The flow of ammonia to the evaporator 32 may be controlled by a control valve rather than the orifice described above, thus providing closed loop control of the temperature in the interior 12 without departing from the spirit and scope of the present invention. The vaporized ammonia then flows from the evaporator 32 to the generator 26 wherein the partially depleted water-ammonia mixture absorbs the ammonia vapor to complete the refrigeration cycle. Often, the evaporate 32 includes two or more sections 32A and 23B that correspond to the interior volume sections 12A and 12B. Preferentially, the upstream evaporator section 12A cools the interior section 12A to maintain the section 12A at a cooler temperature than interior section 12B. Thus, the section 12B may be said to receive residual cooling from the evaporator 12.

Not shown, for clarity, is the insulation around evaporator 32 required to maximize the efficiency of the evaporator 32. Nor are the air registers and duct work to route air from the interior 12, through the evaporator 32, and back to the interior 12 shown in the figures. Additionally, the evaporator 32 may include one or more cooling fins 51 (or other heat transfer surfaces) for increasing the efficiency of removing heat from the interior volume 12. Here, the fins 51 are shown in the interior section 12B. Other arrangements of the evaporator 32 may be provided without departing from the spirit and scope of the present invention.

Figure 2:
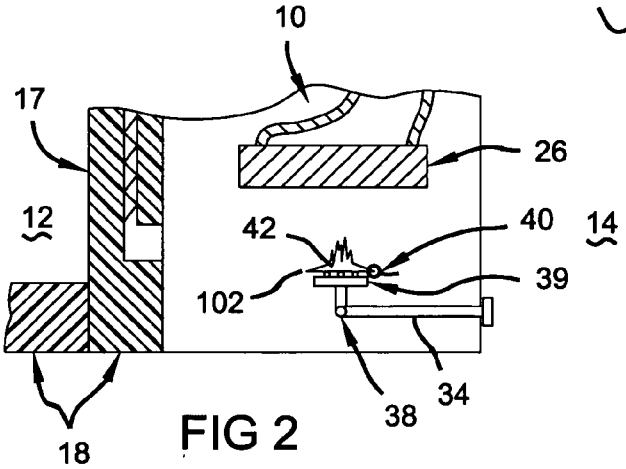
FIG. 2 is an enlarged detail view of a portion of the refrigerator of FIG. 1.

Referring particularly now to FIGS. 1 and 2, heat is required to preferentially vaporize the ammonia in the ammonia-water mixture. The heat source may be an electrical heater, a fire, or any other conventional heat source. In the alternative, both an electrical heater and a fire may be provided with controls to allow the user to switch between sources of heat. In a preferred embodiment, the refrigerator may automatically choose the best available energy source upon which to operate. Though, when the refrigerator is operating with the electrical heat source a relatively large quantity of electrical power must be supplied from a source external to the refrigerator 10 (e.g. from the recreational vehicle electrical system or from a hook up provided at the camp site).

Where a flame 42 is employed, (say to reduce the need for electricity at remote camp sites) a fuel system is included in the refrigerator 10. The fuel system includes a fuel pipe, or source 34, a fuel shutoff valve 38 (shown with control wires), and a connection 37 for an external fuel bottle 36. Since propane is a commonly available fuel, propane is frequently used for the fuel. Though other fuels, solid, liquid, or gaseous, could be employed without departing from the spirit or scope of the present invention.

An igniter 40 is also provided to ignite the fuel from a burner 39 and create the flame 42 as required. The igniter 40 is shown most particularly in FIG. 2. Here the igniter 40 is shown as a spark igniter with electrical wires.

The generator 26 may incorporate the burner 34 as an integral component along with a fan and duct work to move fresh air into, and exhaust gases out of, the generator 26. For clarity, the burner 39 is shown external to the generator 26 and the duct work and fans are omitted from the figures. Even where the burner 39 is not integral with the generator 26 it will typically be at the rear of the refrigerator 10 enclosed within the refrigerator 10.

Since various anomalies may affect the refrigeration system, a possibility exists that the heat source may be attempting to drive the refrigeration system while no cooling may be occurring at the cooling surfaces. In such situations, it becomes desirable to stop the heat source from driving the refrigeration system. Accordingly, the present inventors recognized a need to monitor the temperature of the cooling surface and the status of the heat source to enable turning off the heat source in such circumstances. FIG. 1 schematically illustrates a circuit that performs these functions.

Figure 5:
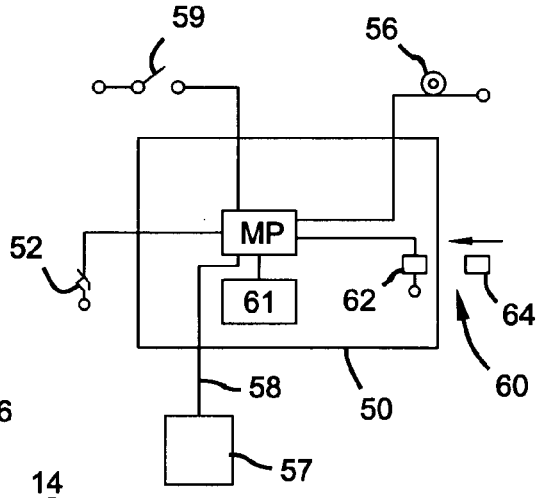
FIG. 5 is a schematic view of the control system of a cooling unit in accordance with th principles of the present invention.

In FIG. 5, a control circuit 50 communicates with a temperature sensor 52, a control valve 38, and a monitor 56. The circuit 50 may include a processor, a PROM, EEPROM, an ASIC chip, or may even be a hardwired circuit. The temperature sensor 52 may be a thermocouple, a thermistor, an RTD (resistance thermal detector), or any other temperature sensing device that is well known in the art. As to the valve 38, it may be any type of valve known in the art capable of opening and closing. Likewise, the indicator 56 may be a light, LED, LCD or any other type of indicator well known in the art. In a preferred embodiment, the indicator 56 includes a red blinking light.

Also shown schematically, a signal 58 is generated by the conventional controls of the refrigerator to indicate when cooling, or refrigeration, of the interior 12 is desired. The circuit 50 may receive the signal 58 from the conventional refrigerator controls 57. In the alternative, the circuit 50 may include means to determine when refrigeration is called for. In such embodiments, the circuit 50 may communicate with interior 12 temperature sensors, door switches, level sensors, ammonia level, pressure, and temperature sensors and other circuitry necessary to determine when refrigeration is appropriate. In another alternative embodiment, the circuit 50 is incorporated in a common circuit with the, otherwise conventional, controls of the refrigerator 10.

During operation, the circuit 50 receives signals representative of the temperature of the cooling fin 51 from the temperature sensor 52. It may also receive the signal 58 indicting whether the interior 12 requires cooling and whether it is appropriate to cool the interior volume (e.g., the refrigerator is level and the door is closed). If cooling is required, the circuit 50 monitors the temperature sensor 52 for a decrease in temperature. If the decrease is sensed, the circuit 50 leaves the valve 38 open. Otherwise, if no decrease in temperature is sensed within a pre-selected time, the circuit 50 closes the valve 38 to isolate (e.g., turn off or shut off) the flow of fuel to the fire. Of course, where the heat source is something other than a flame (e.g. an electric heater) appropriate controls (e.g. a relay) replaces the valve 38. Note also, that if it should become necessary to close the valve, the circuit may also illuminate the monitor 56 to alert the user to the possibility that the refrigerator 10 may need attention.

It should be noted that the refrigeration system 24 may possess the capability to lower the temperature of the cooling fin 51 to a pre-determined minimum temperature. Accordingly, the circuit 50 may command the valve 38 closed only if the cooling fin 51 is above a pre-selected temperature. Additionally, the circuit 50 may include a memory 61 for storing an indication of whether the attempt to cool the interior 12 has previously not succeeded. The memory 61 may be a flip flop, a relay, RAM or any conventional device capable of storing a binary state.

A reset switch 59 may also be provided to allow the user to reset the circuit 50 in the event that an attempt to cool the interior 12 does not produce the desired temperature decrease. In a preferred embodiment, the reset switch 59 is a toggle switch. However, the reset switch 59 may be a push button switch or any other well known device capable of generating a binary (i.e., on/off) signal for the circuit 50. Upon being reset, the circuit 50 clears the monitor 56 and begins monitoring the temperature sensor 52 for temperature decreases anew. It may also clear the stored indication in the memory 61.

In the event that a condition exists that makes cooling the interior 12 inappropriate (e.g. the door is open), the circuit 50 may suspend controlling the valve 38, thereby allowing the valve 38 to remain in its last command position. Of course, when the condition clears the circuit 50 resumes commanding the valve 38.

In alternative embodiments, if the circuit 50 closes the valve 38 because the temperature decrease does not materialize, the circuit 50 may wait for another pre-selected time. At the end of the time, the circuit 50 may then re-open the valve 38 and allow the heat source to resume driving the refrigeration system. If a temperature decrease still fails to materialize within a pre-selected time, the circuit 50 may then close the valve 38 again. Moreover, because two attempts to produce the desired cooling appear to have not succeeded, the circuit 50 may lock out the valve 38 from further attempted openings. In embodiments including the lock out function, a hardware reset 60 may be provided in, or associated with, the circuit 50. For instance, the hardware reset 60 could include a socket 62 for a conductive pin 64, or jumper. If the user desires to reset, or clear, the locked out condition of the circuit 50 and valve 38, then the user inserts the pin 64 into the socket 62 to signal the circuit 50 to clear the lock out. Thus, reset, the circuit 50 may resume controlling the valve 38.

It should also be noted that if the second attempt to cause a temperature decrease does not succeed, then the circuit 50 may alter the indication provided by the monitor 56. For instance, upon detecting the second unsuccessful attempt, the circuit 50 could cause the monitor 56 to flash. Accordingly, once reset by the hardware reset 60, the circuit 50 may clear the flashing indication provided by the monitor 56.

Figure 4:
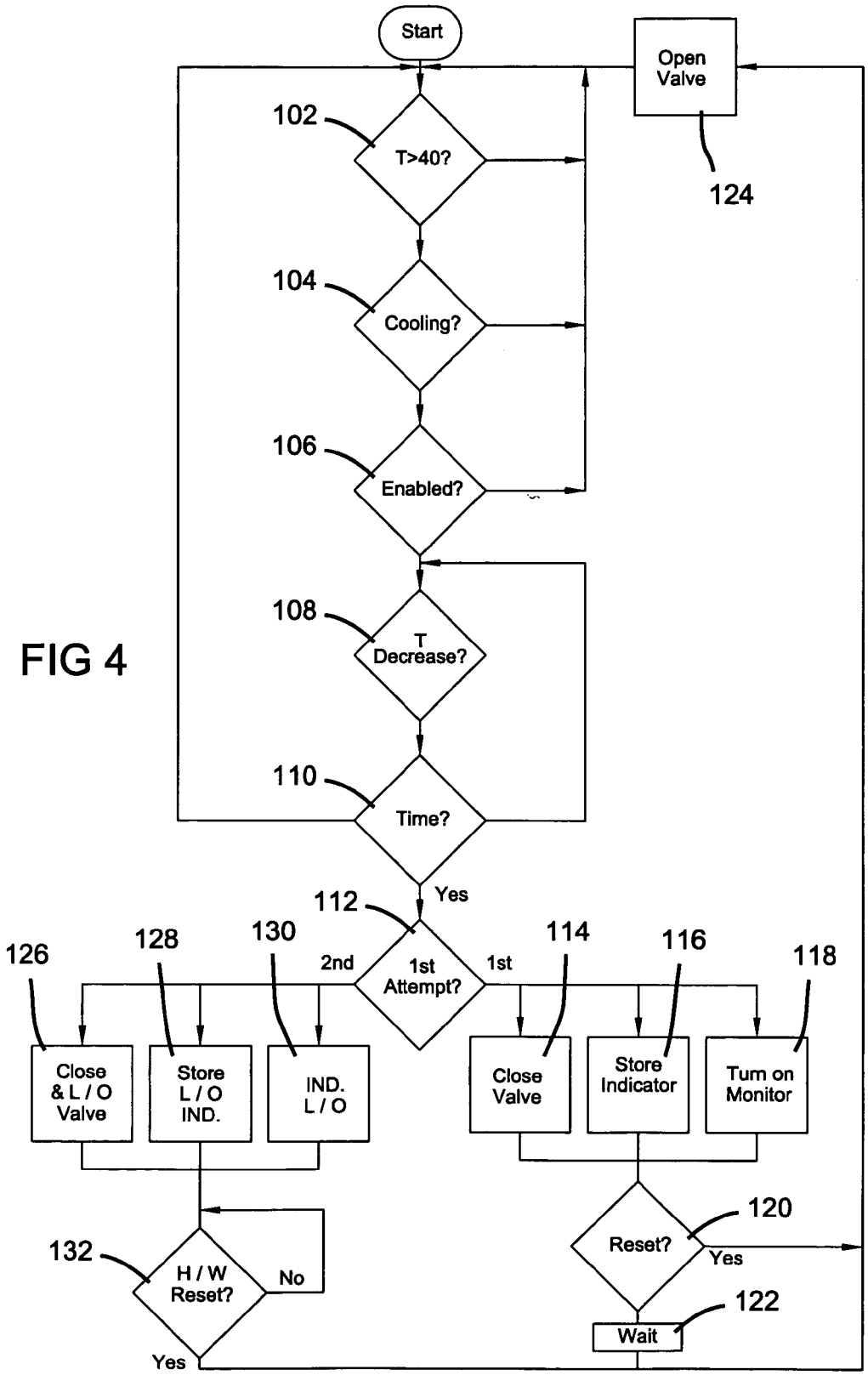
FIG. 4 is a flow-chart illustrating a method, in accordance with the principals of the present invention, of evaluating the operation of the refrigerator of FIG. 1.

Turning now to FIG. 4, an exemplary method in accordance with the principles of the present invention is illustrated. The method 100 includes verifying that the temperature of a cooling surface (e.g., the cooling fin 52) is above a pre-selected temperature (e.g., about 40 degrees Fahrenheit) as in step 102. It will be understood that the temperature of the air within the cooling chamber can be alternatively monitored. If the sensed temperature is greater than, or about equal to, the pre-selected temperature then step 102 repeats until the temperature increases above the pre-selected temperature.

When the temperature rises above the pre-selected temperature, then step 104 verifies that cooling is being called for (e.g. the temperature of the interior volume is above the set point of the refrigerator). If not, then steps 102 and 104 repeat until refrigeration is required. Once refrigeration is called for, a check is made to determine if cooling is enabled in step 106. In other words, the method includes verifying that, for example, the door is closed and the refrigerator is level.

Once refrigeration is enabled, in step 108, the cooling fin temperature is monitored to determine if it is decreasing. If a satisfactory decrease is detected it can be assumed that the refrigeration system is working properly. Accordingly, the method includes returning to step 102. If not, step 110 allows a pre-selected time to expire before the last check for an adequate temperature decrease. In one exemplary embodiment, a decrease of about one degree Fahrenheit over about two hours is satisfactory.

If the temperature has failed to decrease adequately, then a check is made of whether a previous attempt at cooling the interior volume was unsuccessful, as in step 112. If the current attempt is the first unsuccessful attempt, then the valve is closed, an indication is stored of the unsuccessful attempt, and the monitor is turned on to indicate the unsuccessful attempt. See steps 114 to 116.

If a reset occurs (see step 120), then the valve is reopened in step 124. In addition, the monitor and the stored indication may be cleared. Otherwise, in step 122 the method includes waiting a pre-selected time before the valve is opened and another cooling attempt made. In one exemplary embodiment, the delay in reopening the valve extends for about 10 minutes.

The method then repeats steps 102 to 112. Step 110, though, may allow a different pre-selected time in which to monitor for the expected temperature decrease. For instance, the time delay in step 110 for the second attempt to cool the interior volume may be about 40 minutes. After the delay associated with step 110, the valve is closed and locked out if the temperature still refuses to decrease adequately. See step 126 wherein the term "lock out" indicates that the valve will not be re-opened absent a hardware reset.

Additionally, an indication of the second unsuccessful cooling attempt may be stored along with an indication that the valve has been locked out as in step 128. Additionally, the monitor may be changed to indicate that a second unsuccessful attempt occurred and that the valve is locked out. See step 130 wherein the monitor may not be blinking to indicate the lockout.

If a hardware reset occurs then the valve is reopened and the method repeats. Additionally, the monitor and the stored indications may be cleared. See step 132. Otherwise, the valve remains locked out.

The description of the invention is merely exemplary in nature and, thus, variations that do now depart from the gist of the invention are intended to be within the scope of the invention. Such variations are not to be regarded as a departure from the spirit and scope of the invention.

What is claimed is:

1. A control system for a cooling unit comprising:

a temperature sensor adapted to sense a temperature within the cooling unit; and a circuit in communication with a signal from the cooling unit that indicates when cooling of the cooling unit is appropriate and in communication with the sensor, the circuit adapted to turn off a heat source of the cooling unit if the temperature does not decrease within a pre-selected time and cooling is appropriate.

2. The system according to claim 1, wherein the circuit is further adapted to turn off the heat source only if the temperature is above a pre-selected temperature.

3. The system according to claim 1, wherein the circuit is further adapted to turn on the heat source a pre-selected time after turning off the heat source.

4. The system according to claim 3, further comprising the circuit including a memory to store an indication of whether the circuit has turned off the heat source.

5. The system according to claim 4, further comprising the circuit in communication with a reset signal and further adapted to clear the indication if the circuit receives the reset signal and the temperature begins decreasing.

6. The system according to claim 4, wherein the circuit is further adapted to lock out the heat source if the indication indicates that the circuit has turned off the heat source and the temperature does not decrease when cooling is appropriate.

7. The system according to claim 6, further comprising the circuit in communication with a hardware reset and further adapted to clear the lock out only if the circuit receives the hardware reset.

8. A cooling unit comprising:

an interior volume;

a cooling system to cool the interior volume;

a heat source to provide the energy to drive the cooling system;

a temperature sensor adapted to sense a temperature within the interior volume; and a circuit in communication with the sensor and adapted to sense when cooling of the interior volume is appropriate and to turn off the heat source if the temperature does not decrease within a pre-selected time and cooling is appropriate.

9. The unit according to claim 8, wherein the circuit is further adapted to turn off the heat source only if the temperature is above a pre-selected temperature.

10. The unit according to claim 8, wherein the circuit is further adapted to turn on the heat source a pre-selected time after turning off the heat source.

11. The unit according to claim 10, further comprising the circuit including a memory to store an indication of whether the circuit has turned off the heat source.

12. The unit according to claim 11, further comprising a reset switch in communication with the circuit, the circuit further adapted to clear the indication if the reset switch closes and the temperature begins decreasing.

13. The unit according to claim 11, wherein the circuit is further adapted to lock out the heat source if the indication indicates that the circuit has turned off the heat source and the temperature does not decrease when cooling is appropriate.

14. The unit according to claim 13, further comprising a hardware reset in communication with the circuit, the circuit further adapted to clear the lock out only if the circuit receives the hardware reset.

15. The unit according to claim 8, wherein the interior volume further comprising two sections, the cooling system further comprising two evaporators in series, each evaporator to cool one of the interior sections, the cooling fin to be cooled by the evaporator downstream of the other evaporator.

16. The unit according to claim 8, wherein the unit is a refrigerator.

17. A method of controlling a cooling unit, comprising:

sensing a temperature of a cooling surface of the cooling unit;

determining when cooling of the cooling unit is appropriate; and if the temperature does not decrease within a pre-selected time when cooling is appropriate, then turning off a heat source of the cooling unit.

18. The method according to claim 17, wherein the turning off the heat source only occurs if the temperature is above a pre-selected temperature.

19. The method according to claim 17, further comprising turning on the heat source a pre-selected time after turning off the heat source.

20. The method according to claim 19, further comprising storing an indication of whether the circuit has turned off the heat source.

21. The method according to claim 20, further comprising monitoring a reset signal and clearing the indication if the reset signal is received.

22. The method according to claim 20 further comprising locking out the heat source if the indication indicates that the circuit has turned off the heat source and the temperature does not decrease when cooling is appropriate.

23. The method according to claim 22, further comprising monitoring a hardware reset and clearing the lock out only if the hardware reset is received.

24. The unit according to claim 8, wherein the control unit is an absorption refrigerator.

* * * * *